United States Patent [19]

Sherwood

[11] Patent Number: 4,741,273

[45] Date of Patent: May 3, 1988

[54] RAIL SEMI-TRAILER AND RELEASABLE COUPLER

[76] Inventor: Clyde L. Sherwood, 19102 16th Ave., NW., Seattle, Wash. 98177

[21] Appl. No.: 785,105

[22] Filed: Oct. 7, 1985

Related U.S. Application Data

[63] Continuation-in-part of Ser. No. 392,673, Aug. 16, 1982, abandoned.

[51] Int. Cl.[4] ..... B61G 5/02

[52] U.S. Cl. ..... 105/4.1; 280/408; 280/484; 280/487; 280/504

[58] Field of Search ..... 105/3, 4 R; 280/408, 280/482, 483, 484, 485, 486, 487, 488, 489, 504; D12/97

[56] References Cited

U.S. PATENT DOCUMENTS 2,051,958 8/1936 Madison ..... 105/4 R
2,501,721 3/1950 Hagenah ..... 280/484
2,826,155 3/1958 Larsson ..... 105/4 R

FOREIGN PATENT DOCUMENTS 932228 8/1955 Fed. Rep. of Germany ..... 280/504

*Primary Examiner*—John J. Love
*Assistant Examiner*—Mitchell J. Hill

[57] ABSTRACT

A semi-trailer and its releasable coupler for use in rail transportation of intermodal containers and other adaptable cargo. That capability is met by structuring a centered longitudinal beam to the cargo deck and fitting it with the releasable coupler of this invention, permitting the trailer to be one of an infinite number of like trailers joined end to end as a train, the flexibility and longitudinal strength gained through the beam/coupler assembly. Ease of releasing and engaging a trailer from or to the train is made practical by this coupler and the front end supports, the latter having ability to raise and lower the front section of the trailer and separating the coupler segments.

1 Claim, 1 Drawing Sheet

1
2
3
4
5
6
7
8
9
10a
10b
10c
11
12
13

RAIL SEMI-TRAILER AND RELEASABLE COUPLER

This is a continuation-in-part of application Ser. No. 392,673, filed Aug. 16, 1982, now abandoned.

BACKGROUND OF THE INVENTION

Field of the Invention

A consensus exists today by transportation and highway designers and planners that there is an increasingly critical need to return much of what has become highway cargo to rail, with immediate action needed now in the East and shortly throughout the nation. Highway traffic volume continues to increase alarmingly while highway capacity is not expected to expand correspondingly, giving but an indication tody of what the problem will become if the back-to-rail trend is not expedited. At this time that change consists mostly of piggy-back cargo in longhaul (transcontinental, 3rd or 4th day service). The critical next step is to move to rail the much larger volume of radial overnight and 2nd day traffic from the 25 or 30 major national distribution centers. As was realized 40–50 years ago that type of cargo cannot be integrated into conventional rail operations. That attempt brought about today's broad highway transport problem.

The requirements for moving cargo back to rail include a separate rail operating entity perhaps not unlike AMTRAC, though not as a government agency, using present rails under contract with the owners, utilizing available light power units pulling trialers of the type here as one option. Semi-trailers of the type here are not now available onr is a coupler of this type and capacity available to move combinations in excess of, e.g., 200 trailer each grossing 55,000 lbs—or exceeding 11 million pounds dead weight not including the required effort to overcome friction, trackage deflection and varying elevations. Those are the problems and conditions addressed by the trailer and the coupler of this invention.

SUMMARY OF THE INVENTION

This invention is of two parts: a rail semi-trailer for use as one unit releasably joined end to end with an infinite number of similar trailers and, second, a releasable coupler having capability for use in accomplishing that task. The intended purpose of the invention has been discussed above. The detailed structure and functions of the elements will be explained later in the specification. Suffice here to comment that the units of this application consist of: a cargo-carrying deck frame, a longitudinal centered beam the length of the deck frame and slightly beyond, the flanged wheel-air brake assembly, the front end support landing gear with telescopic legs and the releasable coupler of this application which provides the means of joining and disengaging two trailers end to end, the required flexibility in motion and, together with the beam, the longitudinal strength to function as a flexible link in train-long beamed structure involving the weight and stress discussed above.

DESCRIPTION OF THE PREFERRED EMBODIMENT

Figures 1, 2, 3:
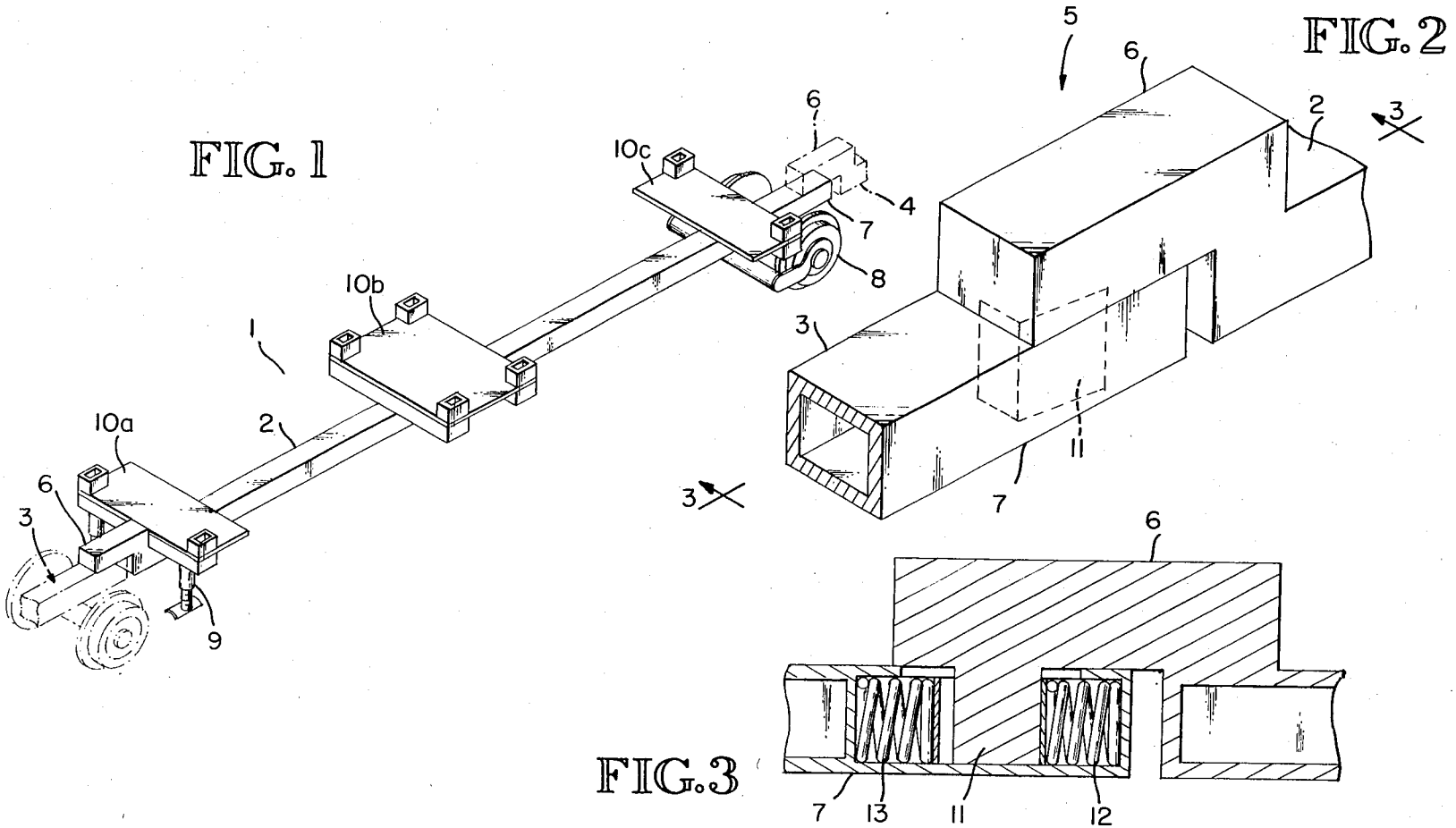
FIG. 1 is a perspective view of the trailer indicating its components and relationship to adjoining trailers.
FIG. 2 is an exterior perspective of the releasable coupler.
FIG. 3 is a cross section of the lower segment of the coupler, shown in FIG. 2, identifying the coupler elements of the joined coupler.

In FIG. 1 is shown trailer 1 with longitudinal main frame beam 2 joined to like beam of preceeding trailer 3 and following trailer 4 by releasable coupler 5 composed of upper segment 6 located on front end of beam 2 and lower segment 7 on rear end of beam 2. As shown here upper segment of trailer 1 is positioned on and bearing down on lower segment 7 of preceeding trailer, segments retained in engaged position vertically by gravity and horizontally by coupler segment elements more fully described in FIG. 3 commentary. Flanged wheel-air brake assembly 8 is located directly under coupler pivot at the rear end of beam 2. That relative position eliminates trailer yaw. Trailer end supports 9 (2) are mounted on bottom surface of front deck frame segment 10*a* cross beam, aligned directly over each track rail on which, in extended position, they rest. That front support assembly has the dual purpose of giving front end trailer support to the disengaged trailer by extending telescopic legs from the raised, travelling position to rest on rails while accepting the weight of the trailer front section and then, through further extension, raising that trailer section and upper coupler segment to a point freeing it from the lower segment, allowing the preceeding unit to be moved forward while retaining this trailer to be subsequently re-engaged, trailer positioned instable manner by the landing gear leg bases being shaped to conform with the upper surface and sides of the rails on which they rest. Vertical leg actuation can be either manually or by use of available air supply from brake source. Cargo deck segments 10*a*, 10*b* and 10*c*, shown here as three spaced platforms to support containers of various lengths, is equipped with quick release tie-downs adapted to those immediate cargo requirements. The deck design can conform to and have capability for other cargo needs.

In FIG. 2 is shown exterior outline of realistic coupler 5. Upper segment 6 attaches as an extension on front end of main frame beam 2 while lower segment 7 attaches as an entension of the rear end of that beam. As shown upper segment of beam 2 is mated to and bearing down lower segment of preceeding trailer and lower segment of beam 2 is mated to and being beared down on by upper segment of following trailer, all in the over and under mode.

In FIG. 3 is shown, in side view, the cross section referred to in FIG. 2, above. In mated mode shown, upper segment tongue extension 11 is extended down from the lower surface of the upper segment and inserted in the cavity in the lower segment, the latter having an opening in the upper surface for that purpose. the tongue is confined, vertically by gravity and horizontally by the confines of the cavity, bearing, when in motion, against the end of either shock absorber spring 12 or 14 which are positioned horizontally and longitudinally with one end of either spring adjacent to the inserted tongue. The springs, when compressed in motion, absorb shock to a level compatible with security of trailer and cargo; they also serve to permit a train of these trailers to be started, stopped, have speed altered or direction changed one trailer at a time, as necessary here as with other train movements. Tongue 11 is shaped as a horizontal wedge, having the narrower, blunted end facing forward opposing the front spring and the wider end opposing the rear spring. This conformation relative to the cavity permits the front end of the tongue to swing within the cavity during cornering movement of the trailer while the width of the rear face eliminates any yawing; to free the tongue to rock with motion created by relative levels of track rails, the rear face can be slightly narrower at the top compared to the bottom. In any event, in order to facilitate easy insertion of the tongue into lower segment cavity under normal conditions, the fit between those element must be less than a tight slip fit. The capacity of the coupler through the tongue is measured in large part by the longitudinal cross section of the tongue and its relationship to the other elements.

Described here, then, is a releasable coupler having new application, lending itself to the movement of combinations of infinite numbers to trailers of this application as well as other trailers compatible to it, the coupler being readily releasable and engagable while providing necessary flexibility together with high longitudinal and vertical capacity as well as being relatively maintenance-free because of its structural approach.

What is claimed is:

1. A railroad semi-trailer and a releasable coupler; trailer for immediate transport of sought-for intermodal-type cargo and other adaptable cargo, made joinable end to end with similar trailers by use of releasable coupler; trailer structured to include: centered longitudinal main frame beam extending to and slightly beyond both front and rear cargo-supporting deck frame segments mounted on top surface of beam; flanged wheel-airbrake assembly extending downwardly from rear end of beam lower surface, positioned to support and give mobility to trailer; trailer front end supports consisting of two legs with pads conforming to rail surfaces extending downwardly from lower surface of front deck frame segment cross beam, fulfilling in a stabilizing means dual purpose of supporting front end of disengaged trailer and as means for engaging and disengaging trailers; and releasable coupler structured of two upper and lower segments mating in over and under mode, lower coupler segment incorporated into rear end of front trailer longitudinal main frame beam consisting of cavity with entry from top beam surface; within that cavity are positioned two shock absorber springs in horizontal and longitudinal mode, each spring having one end adjacent to inserted tongue; tongue is incorporated as an upper segment and downward extension of front end of trailer longitudinal main frame beam, extending when mated with lower segment into cavity between shock absorber springs to form coupler pivot; tongue shaped as a horizontal wedge having narrower blunted end facing forward opposing front spring and wider rear end opposing rear spring; wedge conformation to facilitate free movement of pivot within cavity.

* * * * *